United States Patent [19]

Graham

[11] Patent Number: 4,841,307

[45] Date of Patent: Jun. 20, 1989

[54] FLUID JET APPLICATOR APPARATUS

[75] Inventor: Louis A. Graham, Greensboro, N.C.

[73] Assignee: Burlington Industries, Inc., Greensboro, N.C.

[21] Appl. No.: 128,907

[22] Filed: Dec. 4, 1987

[51] Int. Cl.[4] ..... G01D 15/18; B05C 11/00; B11J 15/24

[52] U.S. Cl. ..... 346/1.1; 346/75; 346/140 R; 118/33; 118/325; 400/611; 400/618

[58] Field of Search ..... 346/1.1, 75, 140 R, 346/136; 118/33, 118, 247, 249, 250, 251, 325; 400/607, 611, 618

[56] References Cited

U.S. PATENT DOCUMENTS

| | | | |
|---|---|---|---|
| 1,847,708 | 3/1932 | Barber | 101/179 |
| 2,027,850 | 1/1936 | Wood | 101/350 |
| 4,068,614 | 1/1978 | Kopachkov | 118/6 |
| 4,131,358 | 12/1978 | Windele | 355/3 TR |
| 4,205,770 | 6/1980 | Wojdyca | 226/49 |
| 4,256,037 | 3/1981 | Vertegaal | 101/115 |
| 4,324,117 | 4/1982 | Schwob et al. | 68/205 R |
| 4,325,301 | 4/1982 | Grosshauser | 101/217 |
| 4,393,772 | 7/1983 | Burger | 101/217 |
| 4,401,028 | 8/1983 | Köbler et al. | 101/178 |

FOREIGN PATENT DOCUMENTS

| | | |
|---|---|---|
| 2334998 | 1/1975 | Fed. Rep. of Germany . |
| 2367141 | 5/1978 | France . |
| 59-1223382 | 12/1984 | Japan . |
| 2051899 | 1/1981 | United Kingdom . |
| 2072727 | 10/1981 | United Kingdom . |

*Primary Examiner*—E. A. Goldberg
*Assistant Examiner*—Gerald E. Preston
*Attorney, Agent, or Firm*—Nixon & Vanderhye, P.C.

[57] ABSTRACT

Fluid jet printing apparatus having a fluid jet printhead and a pair of substrate positioning rolls for moving the substrate between a position below the printhead for printing on the substrate and a position removed from the printhead enabling access to the printhead. Two or more printing stations, each having a fluid jet printhead and substrate positioning rolls, are serially aligned in the direction of movement of the substrate to print different fluids on the substrate. Idler rolls are arranged to effect printing on opposite sides of the substrate at the respective printing stations. The direction of travel of the substrate past the printhead may be in a direction to first pass the catcher and then the droplet streams thereby minimizing or eliminating the tendency of particles to enter the region of the electrodes.

24 Claims, 4 Drawing Sheets

FLUID JET APPLICATOR APPARATUS

BACKGROUND AND SUMMARY OF THE INVENTION

The present invention relates to a fluid jet printing system and particularly relates to apparatus and methods for effecting fluid jet printing serially on one or both sides of a substrate and for minimizing or eliminating shorts in the electrodes of the fluid jet printheads.

Generally, in fluid jet printing, a printhead having a manifold provides fluid, e.g., ink, dye or other chemicals, to an orifice plate through which the fluid issues as a plurality of filaments which break up and form droplet streams. By locating charge electrodes adjacent the filaments, droplets formed from the filaments may be selectively and individually charged. By passing the charged and uncharged droplets through an electrostatic field generated by a deflection electrode, the charged droplets are deflected from a normal downward path toward and onto a collector for recycling back to the manifold. The uncharged droplets are not deflected and therefore fall downwardly on a substrate below the orifice plate. Thus, by selectively charging the droplets, in accordance with a predetermined information signal, pattern printing on a substrate may be effected.

For one-sided application of the fluid to the substrate, it has been found desirable to provide two or more printing stations arranged in series to enable printing operations to be shifted from one printhead to another without stopping the continuous movement of the substrate, e.g., fabric, through the printing stations, to enable servicing of the non-used printhead, and to permit serial application of different printing fluids, i.e., different colors and chemicals. In accordance with the present invention, the rolls carrying the substrate past the printhead at each printing station may be shifted between an operating position lying below the substrate on opposite sides of the printhead whereby the droplet streams deposit fluid on the substrate between the pair of rollers, to an out-of-the-way or inoperative position laterally to one side of the printhead. In this latter position, the printhead of that station may be serviced while the fabric is being printed by the printhead of the other station. Additionally, by using two or more fluid jet printing apparatus in series, two or more different chemicals or dyes may be readily applied to the substrate.

Further, because printheads are inherently capable of printing irrespective of the direction of travel of the substrate thereunder, the substrate, in accordance with the present invention, can be routed through a first fluid jet printing station with a first side up for printing thereon and then routed to travel in the opposite relative direction past the printhead of a second fluid jet printing station with its second side up. Thus, opposite sides of the substrate are sequentially printed, that is to say, a two-sided lash-up or threading configuration enables two-sided printing using two successive printing stations.

Furthermore, it has been found desirable to maintain the electrodes below the orifice plate and above the substrate at each printing station free of dust and other particulate matter during operation of the fluid jet printing apparatus. Particulate matter, such as lint from a fabric passing below and in close proximity to the electrodes, may be displaced from the fabric into the region of the electrodes and short the electrodes whereby the intended printed pattern may not be generated. In this particular fluid jet printing apparatus, it has been found that there is a greater tendency for particulate matter to pass into the region of the electrodes from the substrate when the substrate passes the printhead in one direction in contrast to passing the substrate in the opposite direction. While this phenomena is not fully understood at this time, it is believed related to the location of the catcher along the underside of the print bar and adjacent the droplet stream. Thus, it has been observed that fewer failures, i.e., shorts, in the electrodes occur upon passing the substrate first below the catcher structure, then past the printhead and deflection electrode rather than in the opposite direction, i.e., first past the deflection electrode and then the printhead and catcher.

According to the present invention, there is provided a fluid jet printing apparatus comprising a frame, an elongated fluid jet printhead carried by the frame for printing on a substrate, a pair of laterally spaced rollers carried by the frame substantially coextensive in length with the printhead for locating the substrate in a first position in opposition to the printhead with the rollers located adjacent opposite sides of the printhead, means carried by the frame for mounting said rollers for movement from the first position into a second position spaced from the printhead and means carried by the frame for moving the rollers from the first position into the second position.

In accordance with another aspect of the present invention, there is provided a fluid jet printing system for printing on a continuous substrate comprising first and second fluid jet printing stations, each printing station comprising fluid jet printing apparatus having an elongated fluid jet printhead including a manifold having a reservoir for fluid, an orifice plate for flowing fluid from the reservoir for printing on the substrate, and a pair of laterally spaced rollers substantially coextensive in length with the printhead for positioning the substrate in opposition to the printhead with the rollers located adjacent opposite sides of the printhead, means for continuously feeding the substrate through the first and second printing apparatus, means carried by one of the first and second apparatus for mounting the pair of rollers associated therewith for movement from a first position thereof in opposition to the printhead into a second position spaced from the printhead and means carried by the one apparatus for moving the associated pairs of rollers from the first position into the second position whereby printing may be effected only by the other of the apparatus.

In a still further aspect of the present invention, there is provided a fluid jet printing apparatus comprising a printhead having an orifice plate and a manifold defining a reservoir for fluids whereby said fluid filaments issue through the orifice plate to form fluid droplets, means mounting a substrate in spaced opposition to and for movement past the orifice plate, the printhead including electrode means disposed below the orifice plate and between the orifice plate and the substrate, including a charge electrode for providing electrostatically charged fluid droplets, a catcher disposed below said orifice plate, the electrode means including a deflection electrode for establishing a field to deflect charged droplets through the catcher whereby uncharged droplets are deposited on the substrate and means for moving the substrate along the mounting means in a direction to first pass the catcher, with subsequent deposition of the uncharged droplets on the substrate, whereby the tendency of particulate matter carried by the substrate to enter to region of the electrodes is minimized or eliminated.

A still further aspect hereof provides a method of operating a fluid jet printing system having a fluid jet printhead including an orifice plate and an electrode structure for selectively depositing fluid droplets onto an underlying substrate carried by a pair of rollers comprising the steps of positioning the pair of rollers below the printhead in a first position in opposition to the orifice plate and on opposite sides thereof for receiving the fluid droplets on the substrate and moving the pair of rollers from the first position to a second position removed from the first position thereof whereby the substrate is removed from its position in opposition to the substrate.

Preferably, a plurality of printing stations are provided, with each station having a printhead of the foregoing type. Printing may therefore be provided on the substrate using different dyes or chemicals and on opposite sides of the substrate.

Accordingly, it is a primary object of the present invention to provide novel and improved apparatus and methods for fluid jet printing on a substrate wherein a plurality of fluid jet printing stations comprising a printing system are arranged in series to print a substrate with fluids of different chemicals, dyes, or the like and on one or both sides thereof. The serially arranged fluid jet printing stations enable servicing one or more of the serially arranged printheads while continuously moving the substrate through the printing system, i.e., eliminating system downtime.

It is a further object of the present invention to provide a novel and improved apparatus and methods for minimizing or eliminating shorts in the electrode system of a fluid jet printhead by passing the substrate relative to the printhead in a particular direction relative to the electrode system of the fluid jet printhead.

These and further objects and advantages of the present invention will become more apparent upon reference to the following specification, appended claims and drawings.

BRIEF DESCRIPTION OF THE DRAWING FIGURES

DETAILED DESCRIPTION OF THE DRAWING FIGURES

Reference will now be made in detail to the present preferred embodiment of the invention, an example of which is illustrated in the accompanying drawings.

Figure 1:
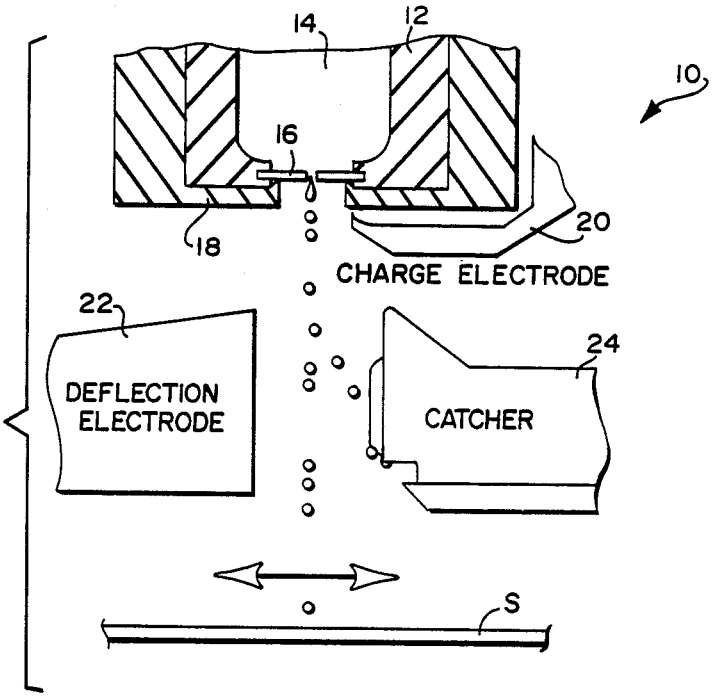
FIG. 1 is a schematic fragmentary elevational view, with parts in cross-section, of a printhead assembly for an ink jet printing device illustrating a portion of a fluid distribution bar and electrode structure for use with the present invention.

Referring now to FIG. 1, there is illustrated a printhead assembly, generally designated 10, disposed above a substrate S for effecting printing on the latter. Particularly, printhead assembly 10 includes a fluid distribution bar 12 having a plenum 14 for containing fluid which issues in the form of filaments through the orifices of an orifice plate 16 otherwise closing the bottom of plenum chamber 14. Clamps 18 are disposed along the underside of the orifice plate to clamp the orifice plate to distribution bar 12. Along the underside of distribution bar 12 is a charge electrode 20, a deflection electrode 22 and a catcher structure 24, the catcher 24 lying opposite deflection electrode 22 such that droplets formed from the filaments issuing through the orifices of orifice plate 16 drop in the area between deflection electrode 22 and catcher 24. As understood by those familiar with fluid jet printing devices, fluid is supplied from the fluid distribution bar to the orifice plate and flows through orifices in the orifice plate to emerge on the underside thereof in the form of fluid filaments directed in a downward direction perpendicular to the orifice plate. These filaments selectively receive a charge potential, by means of charge electrode 20, opposite in polarity and related in magnitude to the electrical potential of charging electrode 20. Charged droplets separated from the fluid filaments are deflected by deflection electrode 22 towards droplet catcher 24, while the uncharged droplets continue downwardly onto substrate S.

Figure 2:
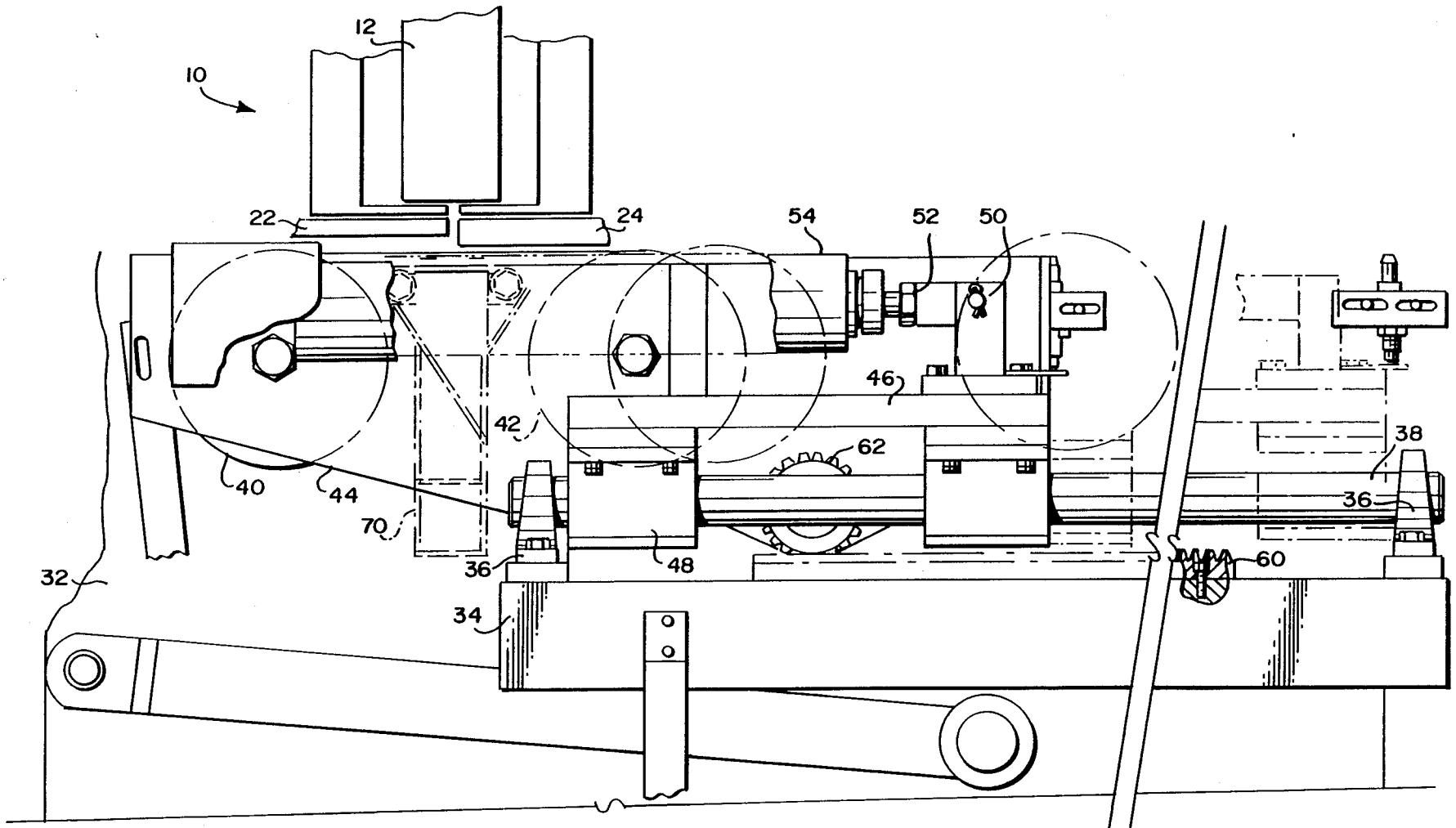
FIG. 2 is a fragmentary side elevational view with parts broken out and in cross-section illustrating, in part, a transport assembly for the substrate below the printhead assembly.

Referring now to FIG. 2, and in accordance with the present invention, there is illustrated a transport mechanism for substrate S disposed below printhead assembly 10. The transport assembly includes a base frame 32 on opposite sides of substrate S, i.e., straddling the longitudinal path of movement of substrate S. Base frame 32 on each of the opposite sides of the transport assembly supports an inwardly directed right angle member 34 which, in turn, mounts a pair of upstanding guide bar support blocks 36 at its opposite ends. Each support block 36 has a central longitudinally extending aperture for receiving an opposite end of a guide bar 38. As will be appreciated from the ensuing description, guide bars 38 along opposite sides of the base frame support a pair of transport rollers 40 and 42 extending transversely between the opposite sides of base frame 32 for longitudinal translational movement between a position where the rollers 40 and 42 lie below the substrate and the printhead assembly 10 on opposite sides of the printhead and a position removed from below printhead assembly 10.

A mounting plate 44 is provided on each of the opposite sides of the transport assembly inwardly of guide bar 38 but outwardly of the ends of rollers 40 and 42. Mounting plates 44 journal the opposite ends of the rollers 40 and 42 at longitudinally spaced positions one from the other and carry the rollers for translational movement therewith, as will be apparent from the ensuing description.

Figure 3:
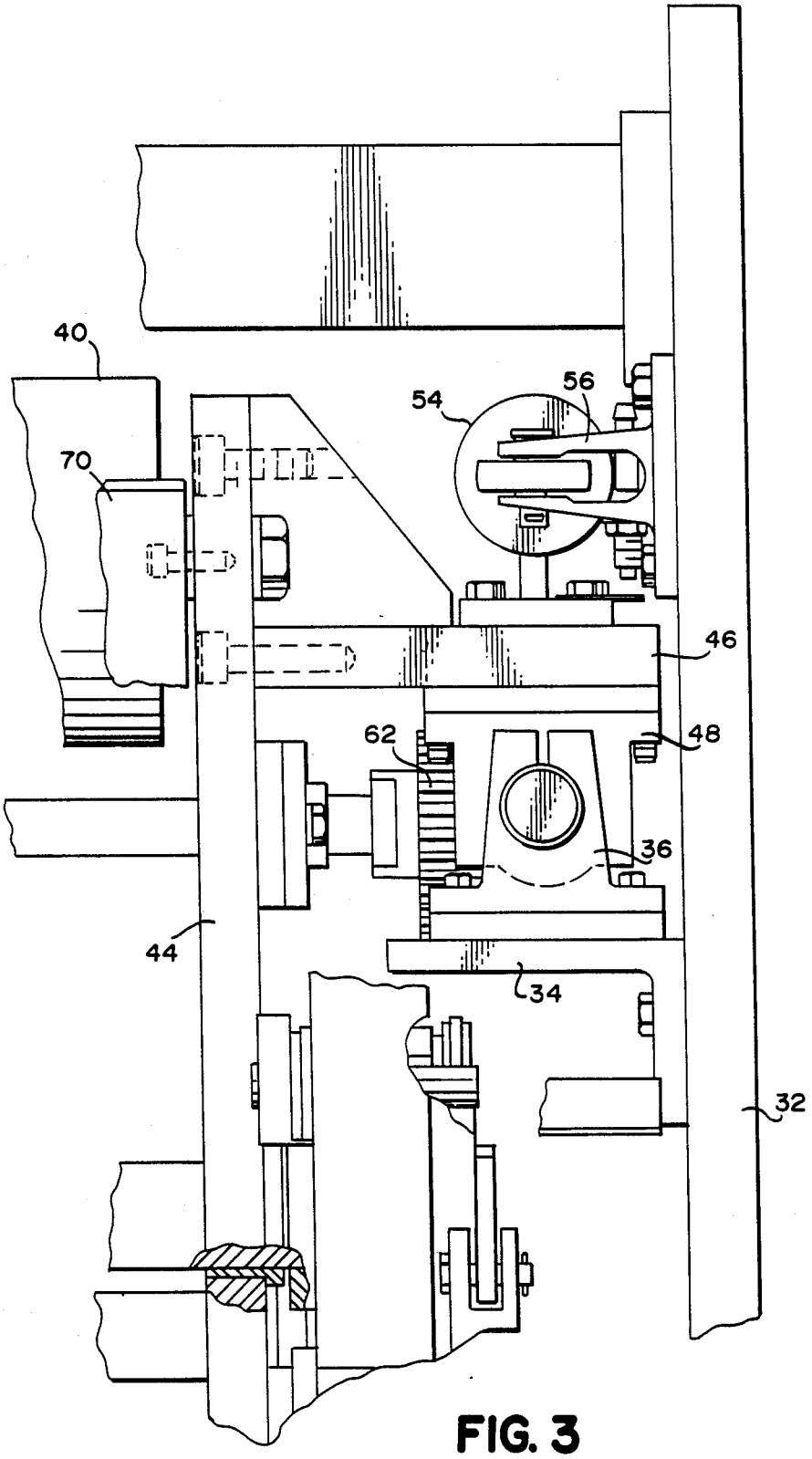
FIG. 3 is a fragmentary end elevational view of one side of the transport assembly illustrated in FIG. 2 with parts broken out and in cross-section.

As best illustrated in FIG. 3, mounting plate 44 is secured to horizontal plate 46 extending outwardly from plate 44 toward base frame 32. Plate 46 carries, adjacent its opposite ends, a pair of depending slides 48 which are engageable about and slidable along guide rod 38. Consequently, rollers 40 and 42, carried at their opposite ends by mounting plates 44, which in turn, are supported by plates 46 and slides 48 mounted on guide bars 34, are all mounted for translational movement between a position locating rollers 40 and 42 on opposite sides of and below the printhead assembly 10 and substrate S and a position indicated by the dashed lines in FIG. 2 longitudinally to one side of printhead assembly 10.

In order to displace this movable substrate transport assembly between such positions, mounting plate 46 carries an upstanding mounting block 50 to which the free end of a piston rod 52 is connected. Rod 52 extends from an air cylinder 54, the opposite end of which is secured in a clevis 56 mounted to base frame 32. Thus, by extension and retraction of the air cylinders along opposite sides of the transport assembly, the transport assembly may be translated between the positions described above.

To maintain accurate transverse alignment of the rollers of the transport assembly, each support 34 also carries a rack 60 which is engaged by a pinion 62. Pinion 62, as illustrated in FIG. 3, is provided on one end of an axle which extends through mounting plate 44 to the opposite side of the transport assembly. At the opposite side, a similar rack-and-pinion arrangement is provided. Consequently, when the transport assembly is translated by operation of air cylinders 54, the rack-and-pinion maintains accurate transverse alignment of the rollers 40 and 42.

In accordance with the present invention, there is provided a catcher tray 70 carried by mounting plates 44. Catcher tray 70 is located between the rollers 40 and 42 and extends the full width of the transport assembly and beyond the ends of the rollers 40 and 42. Catcher tray 70 is located directly below the orifice plate when rollers 40 and 42 are in the first position straddling the printhead assembly and is translatable with the transport assembly into its second position of rollers 40 and 42, as previously explained.

Figure 4:
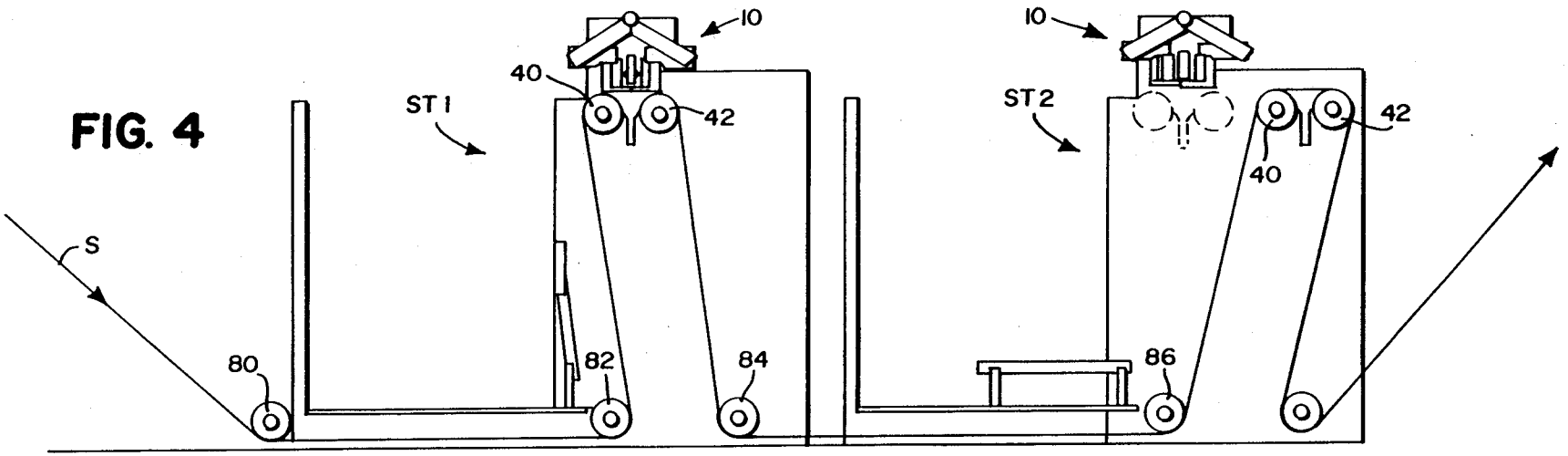
FIG. 4 is a schematic side elevational view of a pair of fluid jet printing apparatus disposed in line for printing on a substrate wherein one or both of the print assemblies may be used.

Referring now to FIG. 4, there is illustrated two inline print stations, designated ST1 and ST2. Each print station has a transport assembly as previously described in conjunction with a printhead assembly for depositing fluid on the substrate passing over the rolls of the corresponding transport assembly. Thus, substrate S moving in the direction indicated by the arrows in FIG. 4 passes below a pair of idler rollers 80 and 82 and upwardly for transport over rollers 40 and 42 of the printhead assembly 10 associated with the printing apparatus of the first printing station STl. The printed substrate issuing from printing station STI is passed below another pair of idler rollers 84 and 86 from which it extends over the rollers 40 and 42 associated with printing station ST2. The transport assembly at station ST2 may be displaced into the print position, indicated by the dashed lines in FIG. 4, whereupon the printhead assembly associated therewith may deposit fluid on the substrate. Consequently, a different color or pattern of fluid or a different chemical may be deposited on the substrate in addition to printing provided the substrate afforded by the print assembly of station ST1. Alternatively, if only a single fluid application is desired, the transport assembly of station ST2 may be translated into an out-of-the-way position illustrated by the full lines in FIG. 4. It will be appreciated that when a transport assembly is positioned out of the way, access is provided to the associated printhead assembly for changeover of fluids or other service as required. It will also be appreciated that either one or both of the printing stations ST1 and ST2 may print, depending upon whether it is desired to effect printing with one or two fluids or service one or the other of the printing apparatus at the printing stations. Also, additional printhead assemblies associated with additional printing stations may be provided for printing with as many different fluids as desired.

Figure 5:
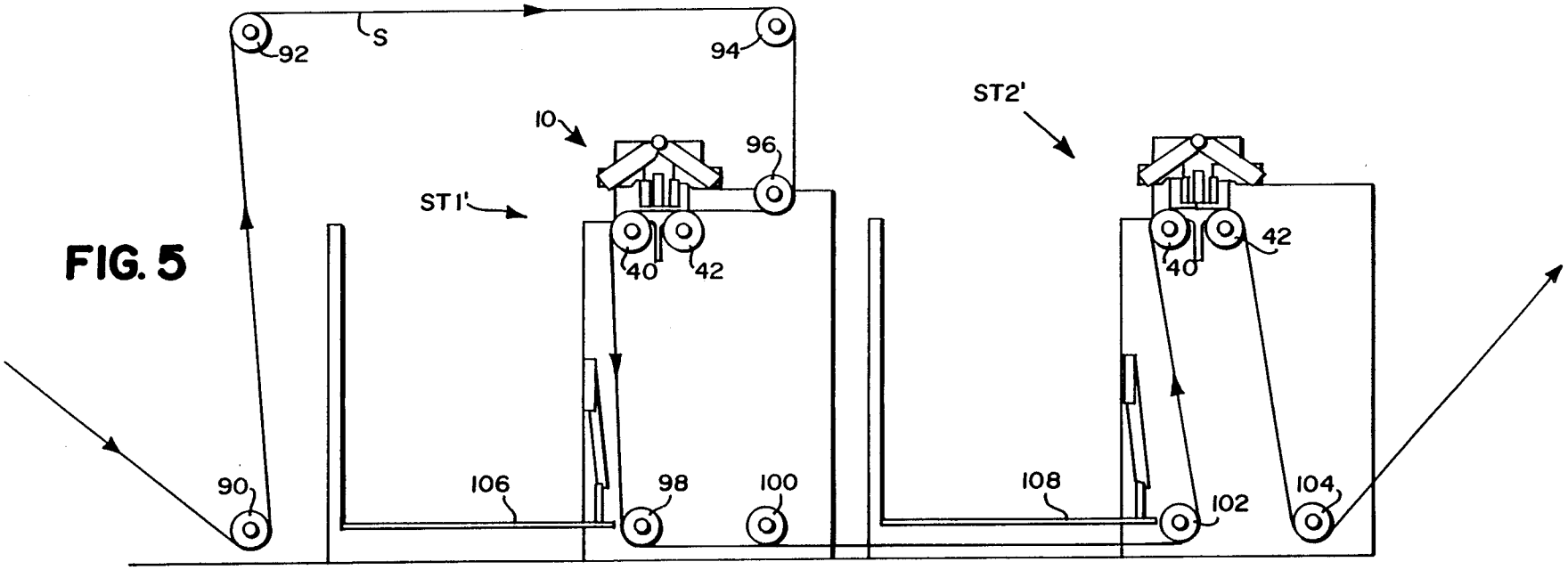
FIG. 5 is a view similar to FIG. 4, illustrating reverse side printing on the substrate in a single run through the apparatus hereof.

Referring now to FIG. 5, there is provided a pair of similar printing stations ST1′ and ST2′. In this arrangement, however, printing is effected on the opposite sides of substrate S, i.e., first on one side by one printing station and then on the other side by the other printing station. To accomplish this, substrate S is disposed about rollers 90, 92, 94 and 96 to pass below the printhead assembly 10 associated with printing station ST1′ in a direction opposite to the direction it would normally pass below the printhead assembly 10, for example, as illustrated at station ST1 in FIG. 4. Thus, substrate S passes over roller 42, below printhead assembly 10 at station ST1′ and then over roller 40, whereby printing is effected on the upper side of substrate S. The substrate is then disposed about additional rollers 98, 100 and 102 enroute to printing station ST2′ where substrate S passes over rollers 40 and 42 in that order below printhead 10. It will be appreciated that the arrangement of rollers 90-102 is such that the opposite side of the substrate is disposed below the printhead assembly 10 at printing station ST2′ from the side of substrate S exposed to printhead assembly 10 at printing station ST1′. By this simple arrangement of the rollers, fluid jet printing is therefore effected on both sides of the substrate S. Roller 104, of course, effects take-off of the double-sided printed substrate from print station ST1′. Also, rollers 90-104 enable the substrate to move between print stations above or below catwalks 106 and 108 in FIG. 5 while rollers 80-86 perform a similar function in the arrangement of FIG. 4.

A particular feature of the present invention resides in the movement of the substrate from the catcher side of the print assembly toward the deflection electrode. As those skilled in this art will recognize, fluid jet printing apparatus conventionally provide for movement of substrate S in a direction from the deflection electrode toward the catcher. As stated previously, it has been found that the reverse movement of the substrate S below the printhead assembly provides fewer shorts in the electrode structure. While the phenomena causing these fewer shorts has not been definitely established, it is believed that the catcher structure which has substantial longitudinal extent and lies slightly closer to the substrate than the deflection electrode causes the particles, for example, lint, to remain on or about the substrate rather than rise therefrom into the electrode structure.

Thus, as illustrated in FIG. 5, substrate S passes below printhead 10 at printing station ST1′ in a direction wherein it first passes below catcher 24 associated with that printhead and then below the associated deflection electrode 22, the printing, of course, taking place when the substrate passes between the catcher 24 and electrode 22. While FIG. 5 illustrates an arrangement of idler rolls to effect this reverse movement of the substrate relative to the printhead, it will be appreciated that the printheads themselves may be reversed in position such that the substrate may pass below the printhead at each printing station in a single longitudinal direction, first passing the catcher and then the deflection electrode, rather than use idler rolls to reverse the direction of movement of the substrate.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A fluid jet printing apparatus comprising:

a frame;

an elongated fluid jet printhead carried by said frame for printing on a substrate;

a pair of laterally spaced substrate transport rollers carried by said frame substantially coextensive in length with said printhead for locating the substrate, in a first position of said rollers, in opposition to the printhead and with said rollers adjacent opposite sides of the printhead;

means carried by said frame mounting said rollers for movement from said first position into a second position spaced from said printhead with said rollers in said second position locating the substrate in a non-print position relative to said printhead; and means carried by said frame for moving said rollers from said first position into said second position.

2. Apparatus according to claim 1 wherein said mounting means enables translational movement of said rollers from said first position into said second position in a direction perpendicular to the axes of said rollers.

3. A fluid jet print apparatus comprising:

a frame;

an elongated fluid jet printhead carried by said frame for printing on a substrate;

a pair of laterally spaced rollers carried by said frame substantially coextensive in length with said printhead for locating the substrate, in a first position of said rollers, in opposition to the printhead and with said rollers adjacent opposite sides of the printhead;

means carried by said frame for mounting said rollers for movement from said first position into a second position spaced from said printhead; and means carried by said frame for moving said rollers from said first position into said second position, said rollers being mounted for movement such that said pair of rollers lie to one side only of the printhead when said rollers lie in said second position.

4. Apparatus according to claim 3 wherein said mounting means enables translational movement of said rollers from said first position into said second position in a direction perpendicular to the longitudinal extent of said printhead and the axes of said rollers.

5. A fluid jet print apparatus comprising:

a frame;

an elongated fluid jet printhead carried by said frame for printing on a substrate;

a manifold including a reservoir for fluid and an orifice plate for flowing fluid from the reservoir in the form of droplets onto the substrate;

a pair of laterally spaced rollers carried by said frame substantially coextensive in length with said printhead for locating the substrate, in a first position of said rollers, in opposition to the printhead and with said rollers adjacent opposite sides of the printhead;

means carried by said frame for mounting said rollers for movement from said first position into a second position spaced from said printhead;

means carried by said frame for moving said rollers from said first position into said second position; and means carried by said frame for mounting a fluid catcher tray for movement generally between a fluid catching position disposed between said pair of rollers when said rollers lie in said first position thereof and in opposition to said printhead for catching fluid not disposed on the substrate and a non-catching position spaced from the printhead.

6. Apparatus according to claim 5 wherein said fluid catcher tray lies generally between said rollers in its non-catching position in the second position of said rollers.

7. Apparatus according to claim 5 wherein said mounting means enables translational movement of the rollers between said first and second positions in directions perpendicular to the longitudinal extent of said printhead and the axes of said rollers, said fluid catcher tray mounting means enabling translational movement of said fluid catcher tray in directions perpendicular to the longitudinal extent of the printhead and the axes of said rollers.

8. Apparatus according to claim 5 wherein said mounting means enables translational movement of said pair of rollers between said first and second positions in directions perpendicular to the longitudinal extent of said printhead and the axes of said rollers with said pair of rollers lying to one side only of the printhead when said rollers lie in said second position, said fluid catcher tray lying generally between said rollers in its non-catching position and in the second position of said rollers.

9. A fluid jet print apparatus comprising:

a frame;

an elongated fluid jet printhead carried by said frame for printing on a substrate;

a pair of laterally spaced rollers carried by said frame substantially coextensive in length with said printhead for locating the substrate, in a first position of said rollers, in opposition to the printhead and with said rollers adjacent opposite sides of the printhead;

means carried by said frame for mounting rollers for movement from said first position into a second position spaced from said printhead;

means carried by said frame for moving said rollers from said first position into said second position; and a second fluid jet printing apparatus comprised of a frame, and an elongated printhead carried by said second frame for effecting printing on the substrate exiting the first fluid jet printing apparatus, a pair of laterally spaced rollers carried by said second frame substantially coextensive in length with the second printhead for locating the substrate in a first position in opposition to the second printhead with the second rollers located adjacent opposite sides of the second printhead.

10. Apparatus according to claim 9 including means carried by said second frame mounting said second rollers for movement from said first position into a second position spaced from the printhead and means carried by said second frame for moving said second rolls from said first position into said second position whereby printing may be effected on the substrate received from said first fluid jet printing apparatus when said second rolls lie in said first position thereof.

11. Apparatus according to claim 9 including means for guiding the substrate over the first and second pairs of rollers, such that said first and second printheads effect printing on opposite sides of the substrate, respectively.

12. A fluid jet printing system for printing on opposite sides of a continuous substrate comprising:

first and second fluid jet printing stations, each printing station comprising fluid jet printing apparatus having an elongated fluid jet printhead including a manifold having a reservoir for fluid, an orifice plate for flowing fluid from the reservoir in the form of droplets onto the substrate, and a pair of laterally spaced rollers substantially coextensive in length with said printhead for positioning the substrate in opposition to the printhead with the rollers located adjacent opposite sides of the printhead; and means for continuously feeding the substrate through the first and second printing apparatus and including means for guiding the substrate over the pairs of rollers of the respective apparatus of said first and second printing stations such that the printheads print on opposite sides of the substrate, respectively.

13. A system according to claim 12 wherein said fluid jet printing apparatus are spaced one from the other in the general direction of travel of the substrate, said guide means directing the substrate through one of the apparatus in a direction opposite to the general direction of travel of the substrate and through the other apparatus in the same direction as the general direction of travel of the substrate.

14. A system according to claim 13 wherein said guide means include a pair of guide rollers carried by each apparatus spaced below the pair of substrate positioning rollers, the substrate being guided by the latter pair of rollers carried by one of said apparatus subsequent to passing the printhead of such apparatus.

15. A system according to claim 14 wherein at least one of the rollers of each pair of guide rollers lies at a common elevation with the other of the rollers of each pair of guide rollers, the substrate travelling from one machine to the other being guided by said one roller whereby the substrate travelling from one machine to the other lies at an elevation below the elevation of the printheads and the pairs of substrate positioning rollers.

16. A system according to claim 13 wherein the guide means for directing the substrate in a direction opposite the general direction of travel of the substrate includes an upper roller spaced above the printhead of the corresponding apparatus for reversing the general direction of travel of the substrate.

17. A fluid jet printing system for printing on a continuous substrate comprising:

first and second fluid jet printing stations, each printing station comprising fluid jet printing apparatus having an elongated fluid jet printhead including a manifold having a reservoir for fluid, an orifice plate for flowing fluid from the reservoir to print on the substrate, and a pair of laterally spaced rollers substantially coextensive in length with said printhead for positioning the substrate in opposition to the printhead with the rollers located adjacent opposite sides of the printhead;

means for continuously feeding the substrate through the first and second printing apparatus;

means carried by one of said first and second apparatus for mounting the pair of rollers associated therewith for movement from a first position thereof in opposition to said printhead into a second position spaced from the printhead; and means carried by said one apparatus for moving said associated pair of rollers from said first position into said second position whereby printing may be effected only by the other of said apparatus.

18. A system according to claim 17 wherein said mounting means enables translational movement of said associated pair of rollers between said first and second positions whereby, when said associated pair of rollers lies in said first position, printing may be effected by both said apparatus.

19. A system according to claim 18 wherein each of said apparatus includes a fluid catcher tray disposed between the pair of rollers in opposition to said orifice plate for catching fluid not disposed on the substrate, said catcher tray on said one apparatus being movable with the associated pair of rollers.

20. A method of operating a fluid jet printing system having a fluid jet printhead including an orifice plate and an electrode structure for selectively depositing fluid droplets onto an underlying substrate carried by a pair of rollers comprising the steps of:

positioning the pair of rollers below said printhead in a first position in opposition to said orifice plate and on opposite sides thereof for receiving the fluid droplets on the substrate;

moving the pair of rollers from said first position to a second position removed from said first position thereof whereby said substrate is removed from its position in opposition to said printhead; and disposing a fluid catcher tray between said rollers in substantially vertical registration with said orifice plate when said rollers lie in said first position thereof, and moving said catcher tray with said pair of rollers from said first position to said second position to move said catcher tray from registration with said orifice plate.

21. A method of operating a fluid jet printing system having a fluid jet printhead including an orifice plate and an electrode structure for selectively depositing fluid droplets onto an underlying substrate carried by a pair of rollers comprising the steps of:

positioning the pair of rollers below said printhead and on opposite sides of the orifice plate in a first position to locate the substrate in opposition to said orifice plate for receiving the fluid droplets on the substrate;

moving the pair of rollers from said first position to a second position removed from said first position thereof whereby said substrate is removed from its position in opposition to said printhead; and first and second fluid jet printing stations in serial alignment one with the other for serially printing on the substrate with each station having a fluid jet printhead including an orifice plate and an electrode structure for selectively depositing fluid droplets onto the underlying substrate carried by an associated pair of rollers and including the further step of printing on the substrate as it passes each printhead with a different fluid.

22. A method according to claim 21, including the steps of moving a pair of rollers at one of the printing stations to its removed position whereby printing is effected by the printing apparatus at the other station.

23. A method according to claim 21 including printing the substrate on opposite sides thereof as it passes through the first and second printing stations, respectively.

24. A method according to claim 23 including the steps of passing the substrate through one of the printing stations below the associated printhead in the general direction of travel of the substrate through the printing system to effect printing on one side of the substrate and passing the substrate through the other of the printing stations below its associated printhead in a direction generally opposite to the general direction of travel of the substrate through the printing system to effect printing on the opposite side of the substrate.

* * * * *